US007490451B2

(12) United States Patent
Matthews

(10) Patent No.: US 7,490,451 B2
(45) Date of Patent: Feb. 17, 2009

(54) METHOD AND APPARATUS FOR MAKING BLOCK BOTTOM PILLOW TOP BAGS

(75) Inventor: David J. Matthews, Gilman, IL (US)

(73) Assignee: Illinois Tool Works Inc., Glenview, IL (US)

( * ) Notice: Subject to any disclaimer, the term of this patent is extended or adjusted under 35 U.S.C. 154(b) by 82 days.

(21) Appl. No.: 11/253,426

(22) Filed: Oct. 18, 2005

(65) Prior Publication Data

US 2007/0084142 A1 Apr. 19, 2007

(51) Int. Cl.
*B65B 61/18* (2006.01)

(52) U.S. Cl. ..... 53/412; 53/133.4; 53/139.2; 53/451; 53/551; 493/213

(58) Field of Classification Search ..... 53/133.4, 53/139.2, 412, 450–452, 550, 551, 554; 493/212–214, 493/218; 156/66, 218
See application file for complete search history.

(56) References Cited

U.S. PATENT DOCUMENTS

| | | | | | |
|---|---|---|---|---|---|
| 3,282,411 | A | * | 11/1966 | Jardine | 206/484 |
| 4,406,646 | A | * | 9/1983 | Jentsch | 493/209 |
| 4,636,190 | A | * | 1/1987 | Herder | 493/196 |
| 4,816,104 | A | * | 3/1989 | Benoit | 156/204 |
| 5,104,235 | A | * | 4/1992 | Bronstrup et al. | 383/10 |
| 5,313,766 | A | * | 5/1994 | Rimondi et al. | 53/451 |
| 5,937,617 | A | * | 8/1999 | Yeager | 53/412 |
| 6,017,412 | A | | 1/2000 | Van Erden et al. | 156/290 |
| 6,151,868 | A | | 11/2000 | Matthews | 53/451 |
| 6,332,712 | B1 | * | 12/2001 | Headley | 383/64 |
| 6,397,561 | B1 | | 6/2002 | Matthews | 53/412 |
| 6,428,642 | B1 | | 8/2002 | Matthews et al. | 156/66 |

(Continued)

FOREIGN PATENT DOCUMENTS

| | | |
|---|---|---|
| GB | 937010 | 9/1963 |

(Continued)

*Primary Examiner*—Thanh K Truong
(74) *Attorney, Agent, or Firm*—Ostrager Chong Flaherty & Broitman P.C.

(57) ABSTRACT

Methods and apparatus for automated manufacture of block bottom pillow top bags. One method includes the following steps: (a) forming a web of bag making material into a tube; (b) joining respective confronting portions of the tube along a transverse line to form a first transverse zone of joinder having a length approximately equal to one half of a perimeter of the tube; (c) forming mutually opposing first and second gussets in the tube, the first and second gussets being separated from each other in the transverse direction by a minimum distance at a predetermined distance from the first transverse zone of joinder, (d) placing product in a portion of an interior volume of the tube disposed above the first transverse zone of joinder; (e) joining confronting portions of the tube along a transverse line to form a second transverse zone of joinder that fixes portions of the first and second gussets that are separated by the minimum distance; (f) cutting the web along a first transverse cut line located below the first transverse zone of joinder; and (g) cutting the web along a second transverse cut line located above the second transverse zone of joinder, the second transverse cut line intersecting the portions of the first and second gussets that are separated by the minimum distance.

19 Claims, 13 Drawing Sheets

U.S. PATENT DOCUMENTS

| | | | | |
|---|---|---|---|---|
| 6,751,932 | B1 | 6/2004 | Matthews | 53/412 |
| 6,796,932 | B2 * | 9/2004 | Kuge et al. | 493/218 |
| 6,807,794 | B2 * | 10/2004 | Ausnit et al. | 53/412 |
| 6,986,237 | B2 * | 1/2006 | Ausnit et al. | 53/412 |
| 7,014,363 | B2 * | 3/2006 | Hanson | 383/120 |
| 2004/0058103 | A1 | 3/2004 | Anderson et al. | |

FOREIGN PATENT DOCUMENTS

| | | | |
|---|---|---|---|
| WO | WO 01/25111 | A1 | 4/2001 |

* cited by examiner

METHOD AND APPARATUS FOR MAKING BLOCK BOTTOM PILLOW TOP BAGS

BACKGROUND OF THE INVENTION

The present invention generally relates to methods and apparatus for making and filling bags having a block bottom and a pillow top.

In the automated manufacture of plastic reclosable packages or bags, it is known to feed a zipper assembly comprising interlocked zipper strips (formed by extrusion) to a position adjacent and transverse to a web of thermoplastic film and then attach one strip of the zipper assembly to the web by means of heat sealing, prior to the web entering a vertical form-fill-seal (VFFS) machine. The zipper assemblies are attached at spaced intervals along the thermoplastic sheet, one zipper assembly being attached to each section of film respectively corresponding to an individual package or bag. The zipper assembly consists of two interlocking zipper strips that typically lie inside the mouth of the package.

In accordance with one known method, zipper assemblies are automatically fed to a zipper application station in the form of a tape that is unwound from a spool. The tape comprises a continuous length of interlocked fastener strips. The continuous tape is fed to a cutting device that cuts the tape at regular lengths to form an individual zipper. Each individual zipper is then attached at spaced intervals to the thermoplastic bag making film by heat sealing or other suitable means. The zipper-carrying film is then pulled through the VFFS machine, which forms, fills and seals successive packages.

There is a need for improved methods and apparatus for automated manufacture of bags having a pillow-style top, a block-shaped bottom, and side gussets extending upward from the bottom but not reaching the top. The method should enable the manufacture of block bottom, pillow top bags with or without a reclosable feature (e.g., a zipper)

BRIEF DESCRIPTION OF THE INVENTION

The present invention is directed to methods and apparatus for automated manufacture of block bottom pillow top bags. The methods may be adapted to make bags that are either reclosable or not reclosable.

One aspect of the invention is a method of making a block bottom pillow top bag, comprising the following steps: (a) forming a web of bag making material into a tube; (b) joining respective confronting portions of the tube along a transverse line to form a first transverse zone of joinder having a length approximately equal to one half of a perimeter of the tube; (c) forming mutually opposing first and second gussets in the tube, the first and second gussets being separated from each other in the transverse direction by a minimum distance at a predetermined distance from the first transverse zone of joinder, the distance of gusset separation increasing from the minimum distance in the directions toward and away from the first transverse zone of joinder; (d) placing an amount of product in a portion of an interior volume of the tube disposed above the first transverse zone of joinder, the amount of product not reaching an elevation where the first and second gussets are separated by the minimum distance; (e) joining confronting portions of the tube along a transverse line to form a second transverse zone of joinder that fixes portions of the first and second gussets that are separated by the minimum distance, wherein the second transverse zone of joinder hermetically seals the filled portion of the interior volume of the tube; (f) cutting the web along a first transverse cut line located below the first transverse zone of joinder; and (g) cutting the web along a second transverse cut line located above the second transverse zone of joinder, the second transverse cut line intersecting the portions of the first and second gussets that are separated by the minimum distance.

Another aspect of the invention is a method of making a block bottom pillow top reclosable bag, comprising the following steps: (a) advancing a web of bag making material in a machine direction by an indexing distance, the web having first and second marginal portions parallel to the machine direction; (b) attaching first and second reclosable features to the web so that the first and second reclosable features each extend in a transverse direction with a spacing between the first and second reclosable features that is substantially less than the indexing distance; (c) joining respective portions of the first and second marginal portions of the web to form a tube; (d) forming mutually opposing first and second gussets in the tube that do not reach the first and second reclosable features; (e) joining respective transverse portions of the web to each other to form first and second transverse zones of web joinder that overlap the first and second gussets, with a spacing between the first and second transverse zones of web joinder that is substantially less than the indexing distance; and (f) cutting the web along first and second transverse cut lines, the first transverse cut line being located between the first and second reclosable features, and the second transverse cut line being located between the first and second transverse zones of web joinder, wherein the first transverse zone of web joinder has a length less than a length of the first reclosable feature.

A further aspect of the invention is a method of making block bottom pillow top bags, comprising the following steps: (a) advancing a web of bag making material in a machine direction by an indexing distance, the web having first and second marginal portions parallel to the machine direction; (b) attaching first and second reclosable features to the web so that the first and second reclosable features each extend in a transverse direction with a spacing between the first and second reclosable features that is substantially less than the indexing distance; (c) joining respective portions of the first and second marginal portions of the web to form a tube; (d) forming mutually opposing first and second gussets in the tube in a region on one side of the first and second reclosable features; (e) joining respective transverse portions of the web to each other to form first and second transverse zones of web joinder that overlap the first and second gussets, with a spacing between the first and second transverse zones of web joinder that is substantially less than the indexing distance; (f) forming mutually opposing third and fourth gussets in the tube on the other side of the first and second reclosable features; (g) joining respective transverse portions of the web to each other to form third and fourth transverse zones of web joinder that overlap the third and fourth gussets, with a spacing between the first and second transverse zones of web joinder that is substantially less than the indexing distance; and (h) cutting the web along first and second transverse cut lines, the first transverse cut line being located between the first and second transverse zones of web joinder, and the second transverse cut line being located between the third and fourth transverse zones of web joinder, wherein the first transverse zone of web joinder has a length less than the length of the first reclosable feature.

Yet another aspect of the invention is a method of making a block bottom pillow top reclosable bag, comprising the following steps: a) advancing a web of bag making material in a machine direction, the web having first and second marginal portions parallel to the machine direction; b) attaching a reclosable feature to the web so that the reclosable feature extends in a transverse direction; c) joining respective portions of the first and second marginal portions of the web; d) forming mutually opposing first and second gussets in the web; e) joining respective transverse portions of the web to each other to form a transverse zone of web joinder that overlaps the first and second gussets; and (f) cutting the web along first and second transverse cut lines that are separated by a distance approximately equal to an indexing distance, wherein the transverse zone of web joinder has a length less than the length of the reclosable feature, and the transverse zone of web joinder and the reclosable feature are disposed between the first and second transverse cut lines.

A further aspect of the invention is a machine having a machine direction of process flow and comprising: means for advancing a web of bag making material in a machine direction intermittently, each advance being separated by a respective dwell time, successive dwell times being alternately designated as odd-numbered and even-numbered; first and second transverse sealing bars that are movable between respective extended and retracted positions, the first and second transverse sealing bars being separated by a first spacing; third and fourth transverse sealing bars that respectively confront the first and second transverse sealing bars when the first and second transverse sealing bars are in their extended positions; fifth and sixth transverse sealing bars that are movable between respective extended and retracted positions, the fifth and sixth transverse sealing bars being separated by a second spacing less than the first spacing and being disposed between the first and second transverse sealing bars; seventh and eighth transverse sealing bars that respectively confront the fifth and sixth transverse sealing bars when the fifth and sixth transverse sealing bars are in their extended positions; first and second gusset plows that are movable in opposite transverse directions between respective extended and retracted positions at a first position along the work pathway; third and fourth gusset plows that are movable in opposite transverse directions between respective extended and retracted positions at a second position along the work pathway, the first through eighth transverse sealing bars being located at positions between the first and second positions; and a cutting instrument for cutting along a transverse line that passes between the locations of the fifth and sixth transverse sealing bars; means for moving the first, second, fifth and sixth transverse sealing bars and the first through fourth gusset plows between their respective extended and retracted positions; and a controller programmed to activate the moving means such that the first, second, fifth and sixth transverse sealing bars are extended and the first through fourth gusset plows are retracted during odd-numbered dwell times, and the fifth and sixth transverse sealing bars and the first through fourth gusset plows are extended and the first and second transverse sealing bars are retracted during even-numbered dwell times.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

The present invention is directed in part to methods of manufacturing a block bottom pillow top bag using automated equipment. These methods have application, for example, to VFFS machines, horizontal flow wrappers and pouching machines. The methods may be used to make block bottom pillow top bags having some form of reclosable feature. The reclosable feature may comprise a zipper with interlocking rib and groove profiles, interlocking hook profiles or interlocking ball-shaped profiles. The zipper may be flanged or flangeless. The zipper could be of a type that is closed by pressing the two zipper strips together or a type that is actuated by a slider. The reclosable feature may take the form of two relatively stiff webs of plastic with respective longitudinal channel, one channel snapping inside the other to achieve closure. Alternatively, the reclosable feature could be pressure sensitive adhesive tape or opposing strips coated with cohesive material.

Figure 1:
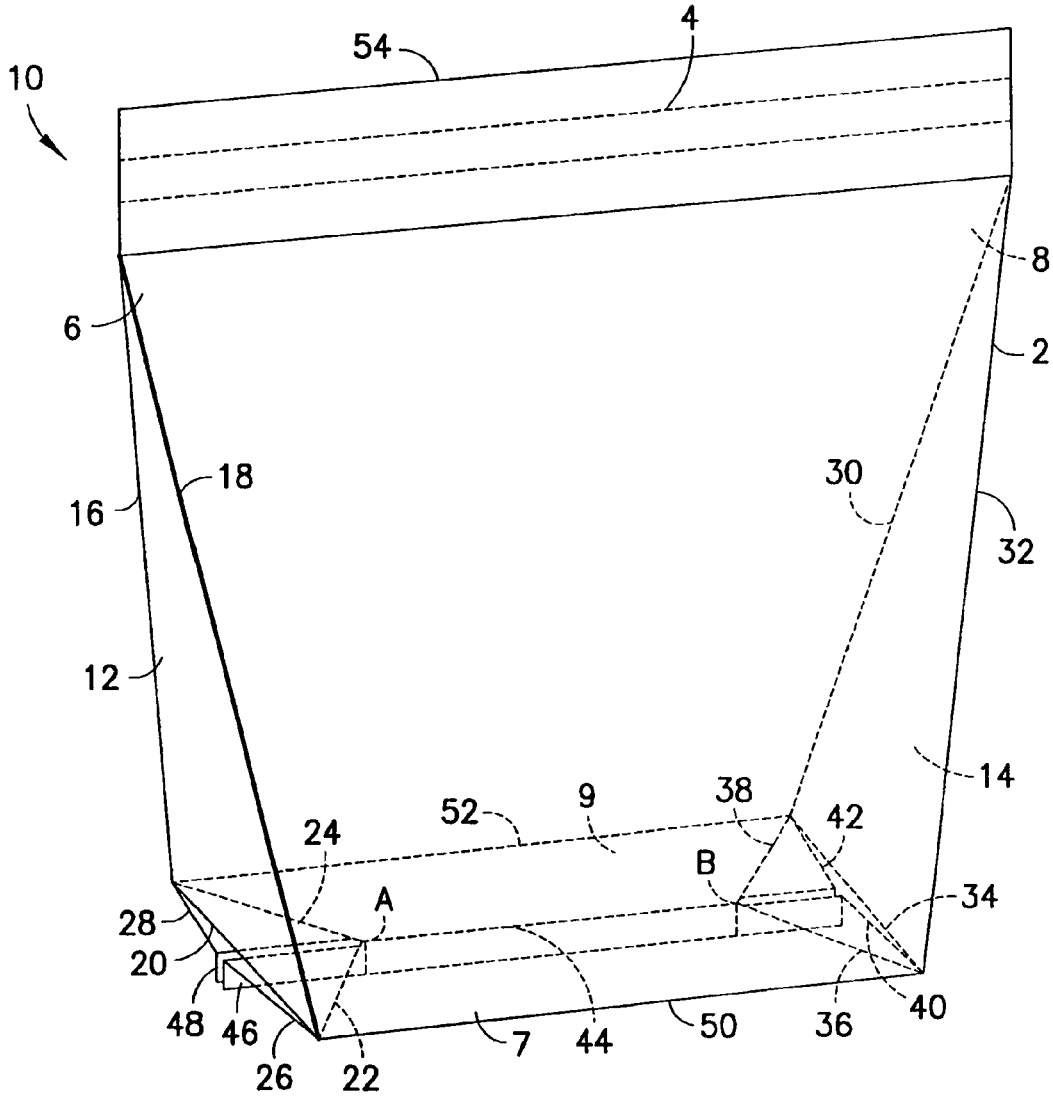
FIG. 1 is a drawing showing an isometric view of a reclosable bag having a pillow-style top and a block bottom.
Figure 2:
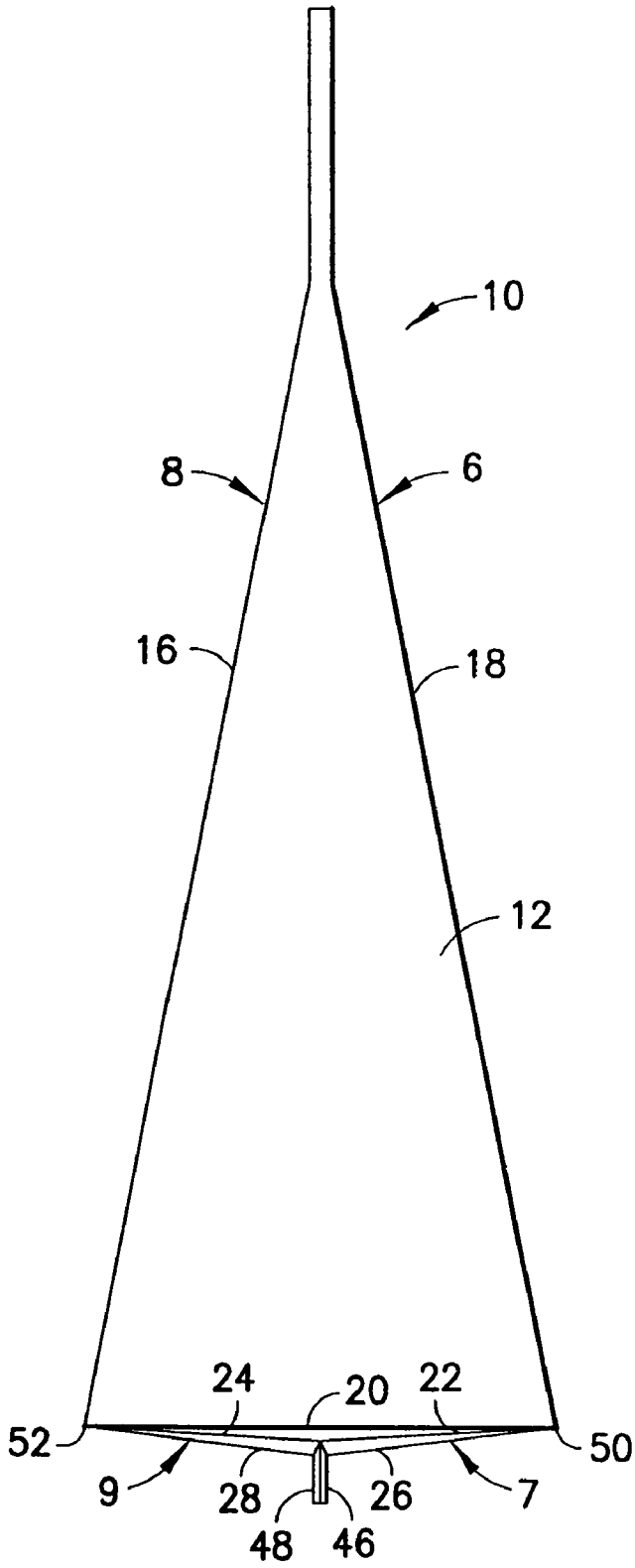
FIG. 2 is a drawing showing a side view of the reclosable bag depicted in FIG. 1.

FIGS. 1 and 2 show a reclosable bag 10 having a pillow top and a block bottom. The bag 10 comprises a receptacle 2 filled with product (not shown) and a reclosable feature in the form of an extruded plastic zipper 4 (indicated by dashed lines) installed in the top portion or mouth of the receptacle. The zipper 4 can be flanged or flangeless. The receptacle 2 is made of bag making film that has been folded and sealed to provide the structure depicted in FIG. 1. The length of the bottom of the receptacle is less than the length of the top or mouth of the receptacle.

As seen in FIG. 1, the receptacle 2 of bag 10 comprises a front wall 6, a first bottom panel 7 connected to the front wall 6 at a fold line 50, a rear wall 8, and a second bottom panel 9 connected to the rear wall 8 at a fold line 52. Each of bottom panels 7 and 9 has a rectangular shape. The receptacle further comprises a first side wall 12 connected to the front wall 6 at a fold line 18 connected to the rear wall 8 at a fold line 16, and a second side wall 14 connected to the front wall 6 at a fold line 32 connected to the rear wall 8 at a fold line 30. As best seen in FIG. 2, the side wall 12 has a triangular shape. The side wall 14 has the same triangular shape. The bottom of the receptacle further comprises a first fin 46 connected to the bottom panel 7 at a first fold line, and a second fin 48 connected to the bottom panel 9 at a second fold line, both fold lines being represented by a single line 44 in FIG. 1 to simplify the drawing. Fold lines 44 extend the full length of the block bottom. In a zone extending from point A in FIG. 1 to point B, the fins 46 and 48 are heat sealed together, this heat seal forming a central portion of a bottom seal of the receptacle 2.

The receptacle further comprises two sets of overlapping triangular portions formed by folding, which triangular portions in turn overlie respective portions of the bottom panels 7 and 9. As seen in FIG. 1, a first equilateral triangle at one end of the bag bottom is bounded by fold lines 20, 22 and 24 (fold line 20 connects that triangle to the bottom of side wall 12), while a second equilateral triangle at the other end of the bag bottom is bounded by fold lines 34, 36 and 38 (fold line 34 connects that triangle to the bottom of side wall 14). The fold line 22 connects the first equilateral triangle to a first right triangle, which is in turn connected to the first bottom panel 7 by a fold line 26 and is also connected to a first folded-over portion of fin 46 that is sealed to a confronting portion of fin 46 to form a first double-layer portion of fin 46, i.e., the two layers of the first double-layer portion of fin 46 are sealed together up to the juncture at point A where this seal meets the central portion of the bottom seal. The fold line 24 connects the first equilateral triangle to a second right triangle, which is in turn connected to the second bottom panel 9 by a fold line 28 and is also connected to a first double-layer portion of fin 48, the two layers of the first double-layer fin portion of fin 48 again being sealed together and extending to point A. Similarly, at the other end of the bag bottom, the fold line 36 connects the second equilateral triangle to a third right triangle, which is in turn connected to the first bottom panel 7 by a fold line 40 and is also connected to a second folded-over portion of fin 46 that is sealed to a confronting portion of fin 46 to form a second double-layer portion of fin 46, i.e., the two layers of the second double-layer portion of fin 46 are sealed together up to the juncture at point B where this seal meets the central portion of the bottom seal. Also the fold line 38 connects the second equilateral triangle to a fourth right triangle, which is in turn connected to the second bottom panel 9 by a fold line 42 and is also connected to a second double-layer portion of fin 48, the two layers of the second double-layer fin portion of fin 48 again being sealed together and extending to point B. FIG. 1 shows the double-layer portions of-fins 46 and 48 being not sealed to each other. However, these double-layer fin portions could optionally be sealed together to form respective joined fin portions that are four film layers thick, as opposed to the central portion of the bottom seal between points A and B, which is only two film layers thick.

Although not shown in FIGS. 1 and 2, the reclosable bag 10 may be provided with a tamper-evident and hermetic seal at the top of the mouth of the bag, i.e., between the zipper 4 and the top edges of the front and rear wall of the bag. FIG. 1 shows the top edge 54 of front wall 6.

The equilateral triangular portions described above respectively connect the side walls 12 and 14 to the respective pairs of right triangular portions. The latter in turn respectively connect the equilateral triangular portions to the bottom panels 9 and 11. As will be described later, the side walls and the equilateral and right triangular portions originate from side gussets that are formed in a film tube during automated manufacture. The film tube is formed by placing mutually parallel marginal portions of a web of bag making film in a mutually confronting relationship and then forming a lap seal or a fin seal. The exemplary bag shown in FIG. 1 has a fin seal (not shown) that runs along a central vertical line from the top edge of the back wall down to fold line 52 and then continued across the bottom panel 9 and across the fin 48.

Figure 3:
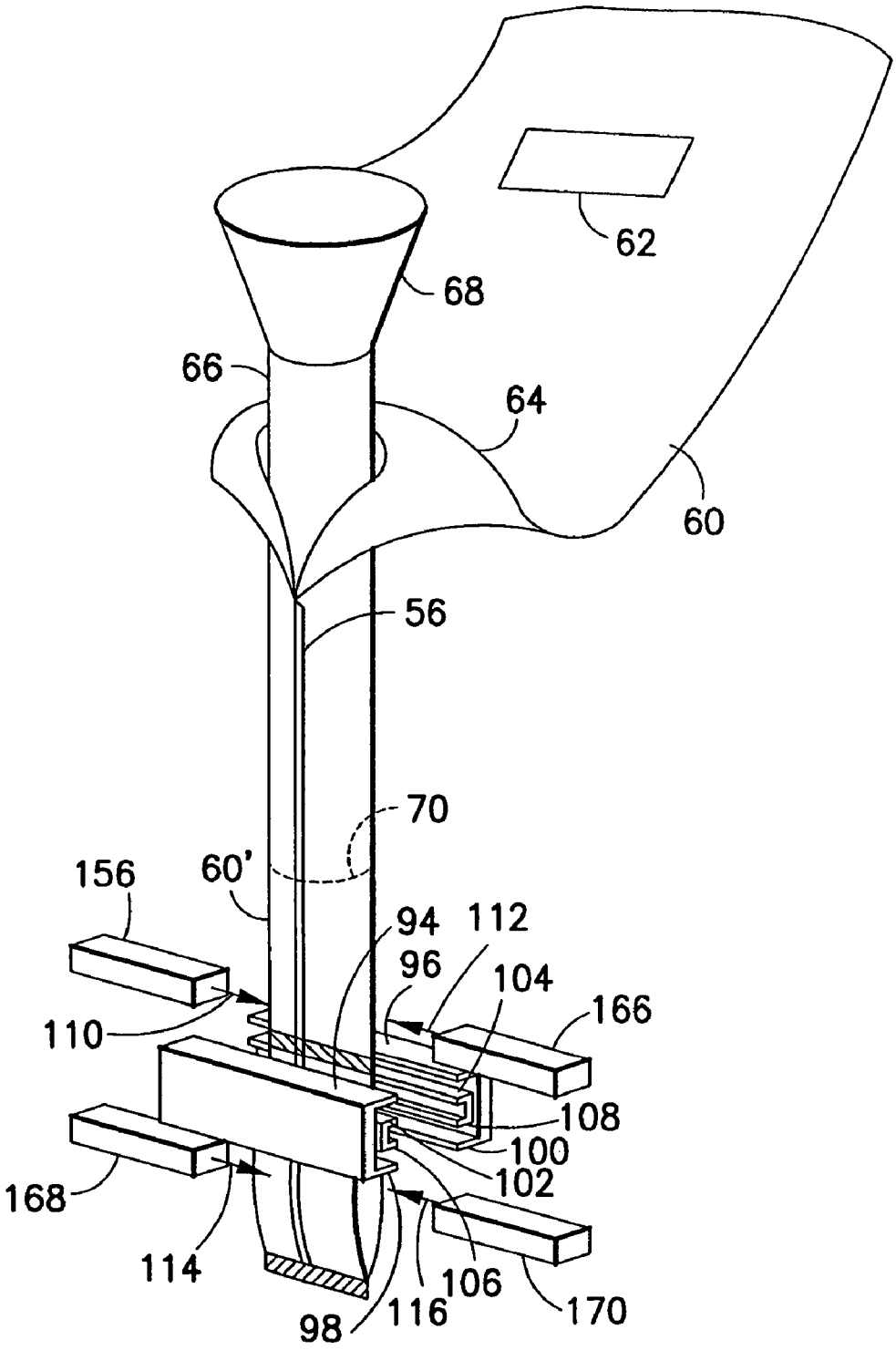
FIG. 3 is a drawing showing an isometric view of a vertical form-fill-seal (VFFS) machine for making reclosable bags of the type shown in FIG. 1, except a set of web spreaders has not been shown to avoid clutter in the drawing.

FIG. 3 is an isometric view of a vertical form-fill-seal (VFFS) machine in accordance with one embodiment of the present invention, for making and filling reclosable bags of the type shown in FIG. 1. The machine comprises a fill tube 66 having a funnel 68 at the top into which product is dropped. An upper portion of the fill tube 66 is partly encircled by a forming collar 64 with a gap (65 in FIG. 4) therebetween.

With the use of a VFFS machine, the print on the web of bag making film must be adjusted in order to compensate for every other bag being manufactured upside-down. As seen in FIG. 3, a web 60 of bag making film with printed matter thereon that is alternately right side up and upside down. The web is supplied to the fill tube 66 with plastic double-zipper assemblies 62 applied at regular spaced intervals thereto. The double-zipper assemblies 62 are oriented in a transverse direction to the length of web 60 and are attached to the center of the web 60. The length of each double-zipper assembly 62 is less than one half of the width of web 60 and is substantially equal to one half of the circumference of the cylinder formed by web 60 when wrapped around the fill tube 66.

In accordance with a first method of manufacture, the double-zipper assemblies 62 are applied at spaced intervals, one double-zipper assembly per length of web needed to make two reclosable bags. Although not shown in FIG. 3, the printing on alternate sections of the web is reversed, each section of the web having a length equal to the web length needed to make one bag. Each double-zipper assembly 62 straddles the boundary between a leading web section with right-side-up printing and a trailing web section with upside-down printing.

Web 60 of film, with attached double-zipper assemblies 62, is drawn over the forming collar 64, through the gap between the forming collar and the fill tube 66, and around the fill tube to form a generally cylindrical shape. Then a vertical seam 56 (e.g., a fin seal or a lap seal) is formed by known methods, e.g., by conventional conduction heat sealing using a pair of vertical sealing bars, thereby forming a film tube 60'.

Figure 4:
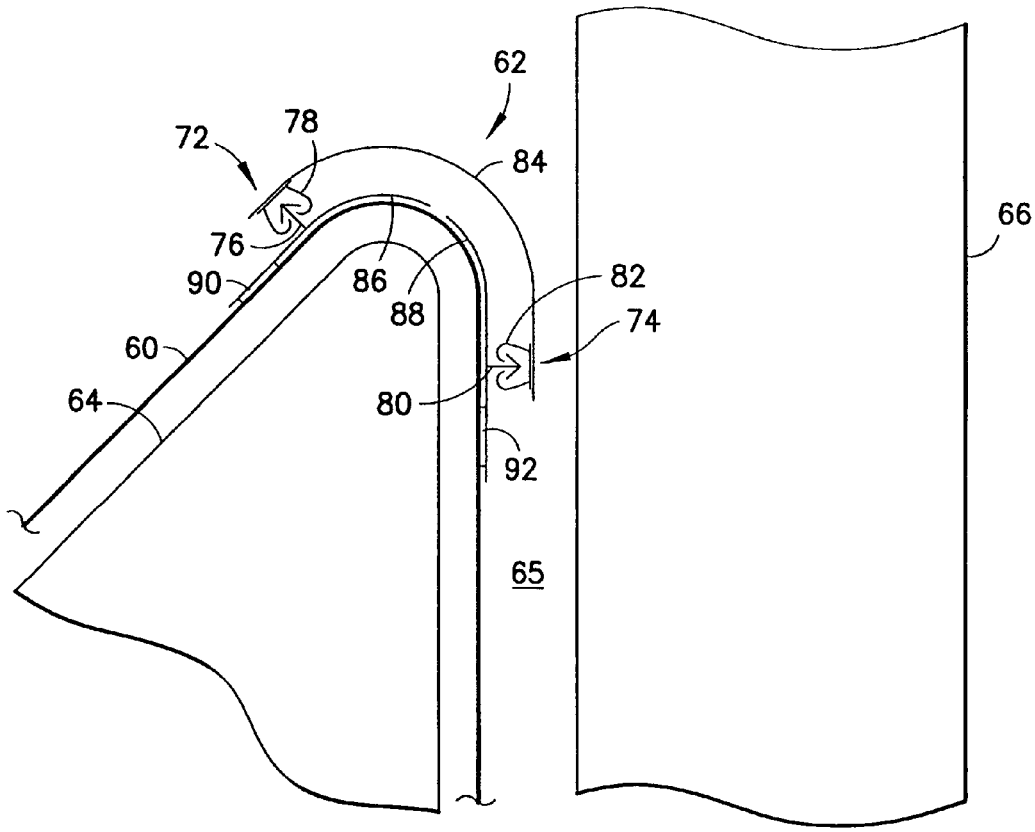
FIG. 4 is a drawing showing a fragmentary view (partially sectioned) of a web of bag making film with attached double zipper passing through the gap between the forming collar and the fill tube of the VFFS machine depicted in FIG. 3.

As best seen in FIG. 4, each double-zipper assembly 62 includes two reclosable zippers 72 and 74. Zipper 72 comprises extruded closure members having complementary male and females profiles 76 and 78 respectively. Similarly, zipper 74 comprises extruded closure members having complementary male and females profiles 80 and 82 respectively. The females profiles 78 and 82 project from and are supported by a common base 84, while the male profiles 76 and 80 project from respective bases 86 and 88. Each of zipper bases 84, 86 and 88 is a respective strip of plastic material of constant width. In one exemplary construction, the widths of bases 86 and 88 are the same, while the width of the common base 84 is greater than the width of bases 86 and 88.

As seen in FIG. 4, the web 60 carries the transversely applied double-zipper assembly 62 over the crown of the forming collar 64 and into the gap 65 between the collar and the fill tube 66. The double-zipper assembly 62 may be attached to the web 60 by conventional conduction heat sealing. In the example shown in FIG. 4, the zipper base 86 is attached to the web 60 along a transverse band-shaped zone of joinder by heat sealing, forming a permanent heat seal 90. Similarly, the zipper base 88 is attached to the web 60 along another transverse band-shaped zone of joinder by heat sealing, forming a permanent heat seal 92. Zipper seals 90 and 92 will be located below the profiles in the finished bags. Additional zipper seals, including sealing the base webs 86 and 88 to web 60 that will be located above the profiles in the finished bags, will be made in a subsequent operation (described in detail below).

As the zipper base 76 passes over the crown of the forming collar 64, the unattached leading edge of the zipper base 76 would normally tend to flare outward and not follow the curvature of the forming collar crown. Such flaring is avoided by the presence of the common base 84, which helps guide the unattached leading edge of the trailing zipper base 76 over the crown of the collar. To the extent that the free edges of the base webs 86 and 88 flare outward as those base webs pass over the crown of the forming collar, such flared edges would be covered by the common base web 84 and unable to catch against the fill tube 66.

Typically the double-zipper assemblies 62 are attached to web 60 prior to supplying web 60 to the VFFS machine. However, the double-zipper assemblies 62 could be fastened to web 60 by a process in-line with the VFFS machine. Such an operation is taught in U.S. Pat. No. 6,151,868, which discloses that a web of thermoplastic film is paid off from a continuous roll thereof in increments equal to the length needed to form each bag being formed on the VFFS machine (hereinafter "the indexing distance"). Each time the film comes to rest, a continuous ribbon of interlocked zipper strips is paid out from a spool on which the zipper ribbon is wound. A zipper-length distal segment of the interlocked zipper strips is positioned on a central portion of the web transverse to the machine direction in which the web is intermittently advanced. The distal segment of the interlocked zipper strips is correctly positioned by a positioning device, with the base of one zipper strip in contact with the web and the other zipper strip interlocked with and overlying the zipper strip that contacts the web. The positioning device can take any of a variety of forms well known to those skilled in the art of manufacturing reclosable packages on FFS machines, such as a vacuum conveyor for pulling the distal segment of the zipper ribbon across the film. When the distal segment is in proper position, a knife or other cutting instrument severs the distal segment from the remainder of the zipper ribbon. The severed segment constitutes a single zipper for a single reclosable package, the single zipper in turn comprising discrete lengths of two interlocked zipper strips. The base of the zipper strip in contact with the web is then joined to the web by an attaching device, such as a pair of transverse sealing bars, at least one of which is heated. The heated sealing bar applies sufficient heat to cause the thermoplastic film to soften or melt and then fuse to the base web of the zipper strip upon cooling, thereby forming a zipper/film zone of joinder along the discrete length of the zipper strip.

For purposes of the present invention, the method of zipper attachment disclosed in U.S. Pat. No. 6,151,868 would need to be modified to take into account the fact that a double zipper, not a single zipper, needs to be attached to the film web. If zippers are to be attached in-line with the VFFS machine, then the appropriate method of the present invention would entail the formation of two mutually parallel heat seals (seals 90 and 92 shown in FIG. 4) using two pairs of sealing bars instead of one pair.

The respective zippers of the double-zipper assembly are designed and placed for the purpose of forming the tops of two adjacent and connected reclosable bags, the lower of the two bags being right side up and the upper of the two bags being upside down. The zippers are oriented on the double-zipper assembly so that the consumer side of each zipper is facing the center of the double-zipper assembly and the product side is facing the outside edges of the double-zipper assembly.

Referring again to FIG. 3, a film tube 60' is formed by wrapping the web 60 around the fill tube 66 and then joining marginal portions of the web along a vertical seam 56. In accordance with the embodiment depicted in FIG. 3, the film tube 60' is advanced intermittently by an indexing distance that equals the length of film needed to make a single pillow top block bottom bag. [In another embodiment to be discussed later, wherein saddlebags are made, the indexing distance will be equal the length of film needed to make two pillow top block bottom bag connected at their tops in saddlebag fashion.] As seen in FIG. 3, the printing on alternate reclosable packages coming off of the VFFS machine is reversed, i.e., in the bag just completed, the print is right side up, while in the next bag to be made, the print is upside down, and so forth.

In accordance with the embodiment depicted in FIG. 3, the VFFS machine comprises two pairs of mutually opposing reciprocatable zipper sealing bars (94, 96, 98, 100) and two pairs of mutually opposing reciprocatable web cross sealing bars (102, 104, 106, 108). The sealing bars are located at elevations lower than the elevation of bottom 70 of the fill tube 66, and move toward or away from each other in directions perpendicular to a plane defined by the machine and transverse directions. The zipper sealing bar 94 opposes the zipper sealing bar 96, while the zipper sealing bar 98 opposes the zipper sealing bar 100. The zipper sealing bars 94 and 98 are separated by a first spacing; the zipper sealing bars 96 and 100 are also separated by the first spacing. The web cross sealing bar 102 opposes the web cross sealing bar 104, while the web cross sealing bar 106 opposes the web cross sealing bar 108. The web cross sealing bars 102 and 106 are separated by a second spacing less than the first spacing; the web cross sealing bars 104 and 108 are also separated by the second predetermined spacing. The web cross sealing bars 102 and 106 are disposed between the zipper sealing bars 94 and 98; the web cross sealing bars 104 and 108 are disposed between the zipper sealing bars 96 and 100.

FIG. 3 shows the zipper sealing bars 94 and 98 being mechanically linked to each other, as are the zipper sealing bars 96 and 100. The cross sealing bars on the same side of the film tube are also depicted as being mechanically linked. This can be accomplished by attaching linked sealing bars to the same mounting plate, which mounting plate is attached to the end of the piston rod of a pneumatic cylinder for effectuating reciprocation. However, a person skilled in the art will appreciate that such mechanical linkages are not necessary to practice of the present invention. Each sealing bar could be coupled to a respective actuator, the actuators of synchronized sealing bars being controlled by the PLC to operate concurrently.

Figure 5:
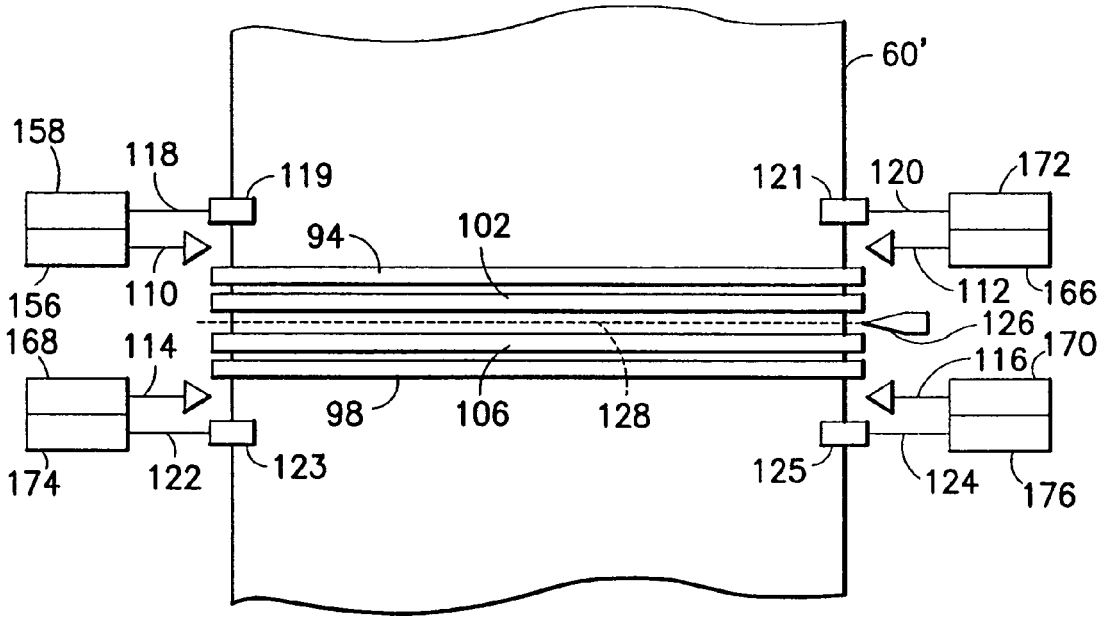
FIG. 5 is a drawing showing various components of a machine in accordance with the first embodiment of the invention.

The VFFS machine shown in FIG. 3 further comprises two pairs of mutually opposing reciprocatable gusset plows (110, 112, 114, 116) respectively disposed above and below the sealing bars. Each gusset plow is displaced transversely by a respective gusset plow actuator capable of either extending or retracting the gusset plow. For example, each gusset plow actuator may comprise a respective worm gear driven by a respective servomotor. As best seen in FIG. 5, the gusset plows 110, 112, 114, 116 are displaced by respective actuators 156, 166, 168, 170.

The first embodiment of the invention further comprises two pairs of mutually opposing reciprocatable spreaders, which have not been shown in FIG. 3 to avoid clutter in the drawing. However, those spreaders (as well as the sealing bars and gusset plows) are shown in FIG. 5, designated by reference numerals 118, 120, 122, 124. Each spreader is displaced transversely by a respective spreader actuator capable of either extending or retracting the spreader. As shown in FIG. 5, the spreaders 118, 120, 122, 124 are displaced by respective actuators 158, 172, 174, 176. In accordance with one implementation, each spreader actuator may comprise a pair of parallel grippers actuated by a double-acting pneumatic cylinder (not shown in FIG. 5), which arrangement is mounted to a plate that displaces transversely in response to rotation of a worm gear driven by a servomotor. The cylinder actuates the grippers for gripping the sides of the film tube. The closed grippers are then retracted to spread the film tube. Only one gripper of each spreader is shown in FIG. 5, these being designated by the numerals 119, 121, 123, 125.

The first embodiment further comprises a knife or other cutting instrument (not shown in FIG. 3) that separates the bottoms of two adjacent reclosable packages, thereby allowing the lowermost reclosable package (which previously has had its upper seal area formed and has been filled with product) to become free of the web and continue as a completed package. In FIG. 5, the blade of this cutting instrument is represented by triangle 126 and the transverse cut is represented by dashed line 128. The knife may be operated independently or it can be mechanically linked to one pair of the cross sealing bars, a backing in opposition to the knife being mechanically linked to the opposing pair of cross sealing bars.

Figure 10:
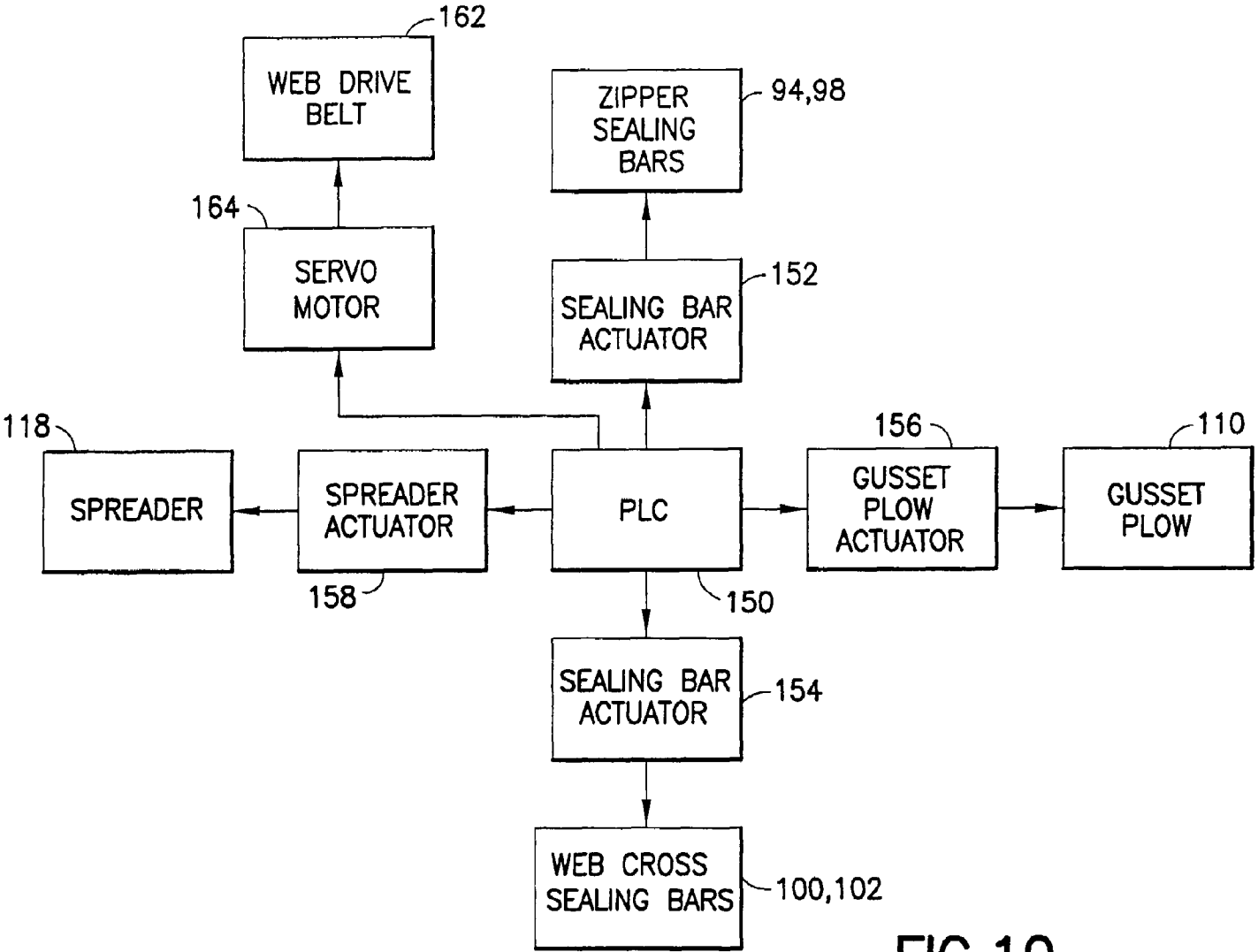
FIG. 10 is a block diagram representing a system for controlling actuation of various components of the machines depicted in FIGS. 5 and 9.

The sealing bars, gusset plows, spreaders, and knife operate intermittently during dwell times in accordance with a predetermined routine dictated by a programmed logic controller (not shown in FIGS. 3 and 5, but see item 150 in FIG. 10). In accordance with the first embodiment of the invention shown in FIG. 5, the cross sealing bars 102 and 106 (and the opposing cross sealing bars 104 and 108 not shown in FIG. 5, but shown in FIG. 3) and the cutting instrument 126 operate during every dwell time, i.e., during every cycle of operation. In contrast, the zipper sealing bars 94 and 98 (and the opposing zipper sealing bars 96 and 100 not shown in FIG. 5, but shown in FIG. 3) and the spreaders 118, 120, 122, 124 operate only during every odd-numbered dwell time or cycle of operation, whereas the gusset plows 110, 112, 114, 116 operate only during every even-numbered dwell time or cycle of operation. FIG. 5 depicts the spreaders and gusset plows in their respective positions during an odd-numbered dwell time, i.e., the spreaders are shown in their extended positions and the gusset plows are shown in their retracted positions. During even-numbered dwell times, the spreaders will be retracted and the gusset plows will be extended.

Figure 6:
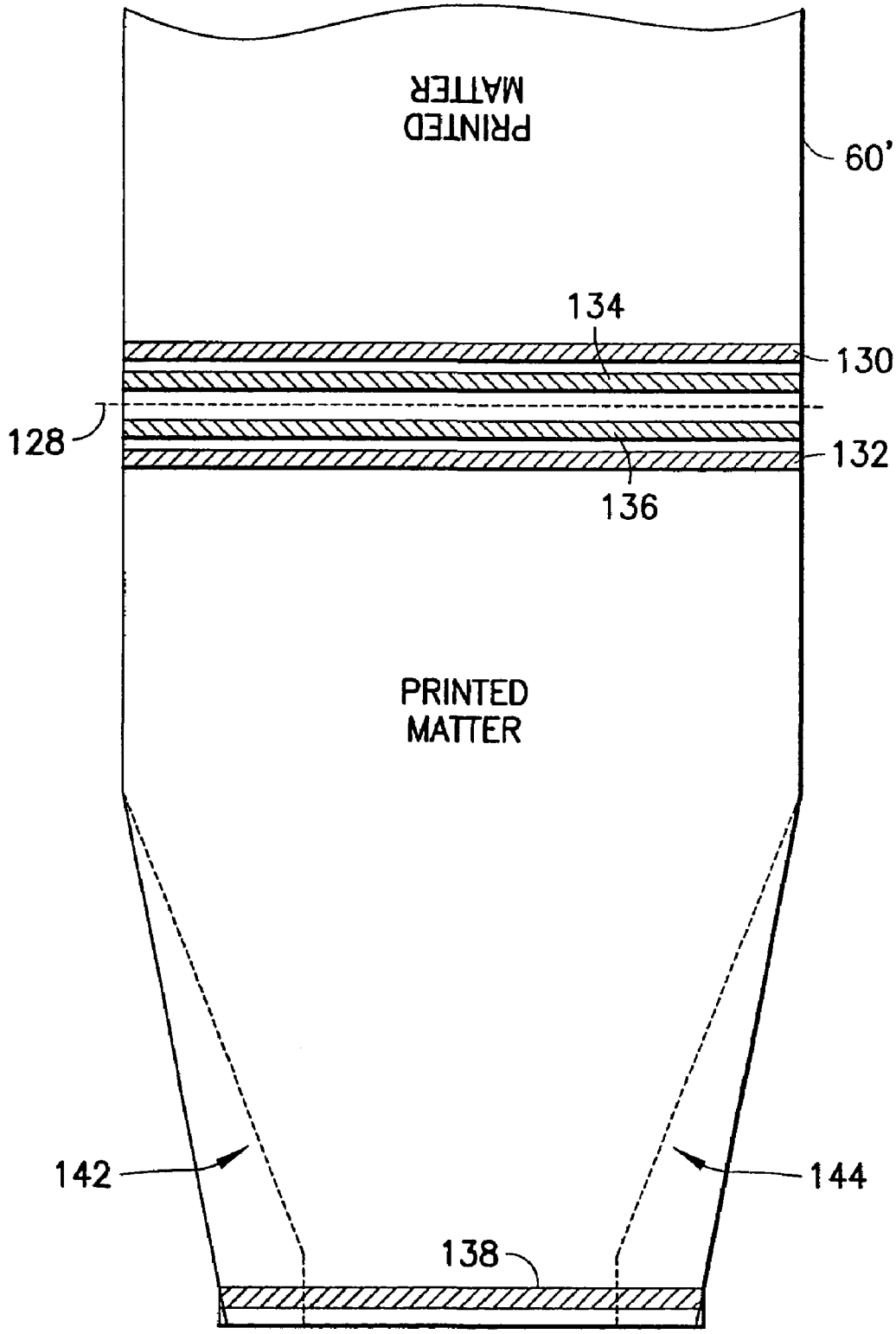
FIG. 6 is a drawing showing a front view of a reclosable bag during an odd-numbered dwell time and just prior to being severed from the remainder of the work in process in accordance with a first method of manufacture that requires reversal of the printed matter on alternating bags. Various transverse seals are indicated by hatching.
Figure 7:
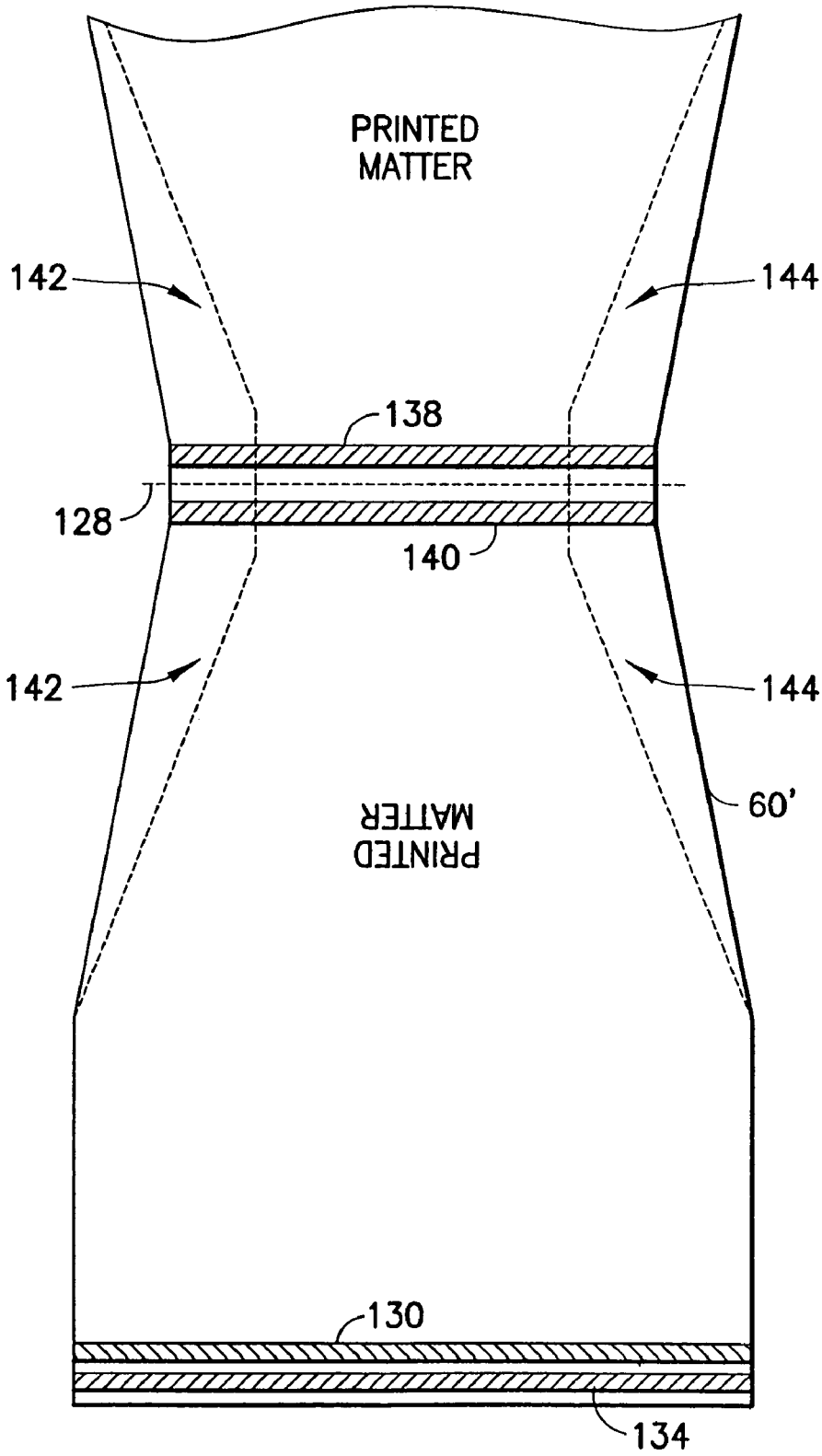
FIG. 7 is a drawing showing a front view of another reclosable bag during an even-numbered dwell time and just prior to being severed from the remainder of the work in process in accordance with the first method of manufacture. Again various transverse seals are indicated by hatching.

The operations performed on the double zipper/film tube assembly by the components depicted in FIG. 5 during odd-numbered dwell times are shown in FIG. 6, while the operations performed during even-numbered dwell times are shown in FIG. 7 for a first method of manufacture. In FIG. 6, the leading bag has right-side-up printing, while the next bag above it has upside-down printing. FIG. 7 shows the same bag with upside-down printing after the bag with right-side-up printing has been severed and the bag with upside-down printing has been advanced downward by the indexing distance. For the purposes of clear disclosure, the convention has been adopted herein that a reclosable bag with printing right side up is severed during odd-numbered dwell times, and that an upside-down reclosable bag (with upside-down printing) is severed during even-numbered dwell times.

Each spreader may comprise a respective pair of mutually opposing reciprocatable grippers that move perpendicular to the plane defined by the machine and transverse directions when gripping or releasing a respective folded portion of the web, and which displace transversely when spreading the web. During each odd-numbered dwell time, the spreaders are extended with their grippers open. In their extended positions, the sides of the film tube are disposed between the open grippers. The grippers are then closed to grip the film tube on opposite folded sides. Then the spreaders, with closed grippers, are retracted, thereby spreading the film tube so that it lies in a plane.

With the film tube 60' in a fully spread state, the web cross sealing bars are extended to form a pair of top cross seals 134 and 136 (see FIG. 6), and the zipper sealing bars are extended to form two zones of zipper/web joinder 130 and 132. In zones 130 and 132, the flanges on both sides of the double zipper are joined to a respective side of the web, as will be explained in detail later with reference to FIGS. 14-17. The sealing bars can be alternately extended and retracted by means of respective double-acting pneumatic cylinders.

Also during each odd-numbered dwell time, the film tube 60' will be cut along transverse cut line 128 to sever the most recently finished package from the remainder of the work in process. At the stage of manufacture shown in FIG. 6, the package below the cut line 128 has not yet been filled. Therefore, that package is shown with side gussets 142 and 144 and a bottom cross seal 138 that overlaps the gusseted portions, which features are formed by manufacturing steps to be described in the next paragraph with reference to FIG. 7. The significance of the package being not filled is that upon filling, the weight of the product inside the package will push portions of the side gusset panels outward to form the block bottom depicted in FIG. 1. This event is not depicted in FIG. 6. Only after the package has been filled will seals 130, 132, 134 and 136 be made, and only thereafter will the film tube be cut along transverse cut line 128 depicted in FIG. 6.

Figure 8:
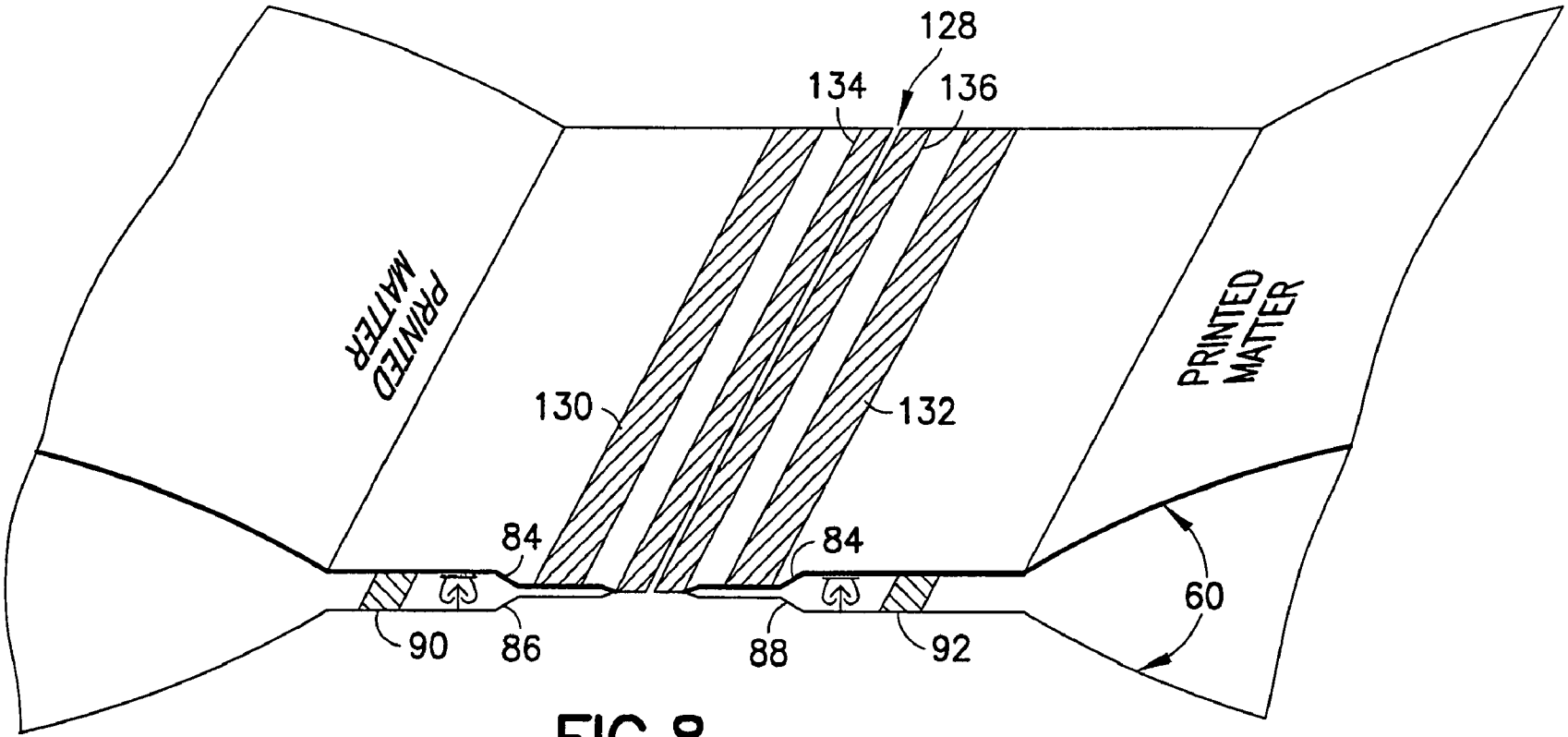
FIG. 8 is a drawing showing a fragmentary isometric view (sectioned) of a film tube with attached double zipper at the instant of cutting in accordance with a variation of the first method of manufacture.

The locations of the transverse zones of zipper/web joinder 130 and 132 relative to the transverse zones of zipper/web joinder 90 and 92 are shown in FIG. 8, along with the top cross seals 134 and 136, where the web is sealed to both sides of a central portion of the common base 84. However, it is not necessary that the cross sealing bars consist of spaced-apart sealing bars. A single set of wider sealing bars could be used to make the top cross seals 134 and 136 provided that the transverse cutting instrument were designed to cut in a subsequent operation instead of concurrently. FIG. 8 shows a transverse cut line 128 that has been made through the middle of such a wide seal, the sealed portions on opposite sides of the cut line constituting the top cross seals 134 and 136 of respective reclosable packages. Alternatively, a set of even wider heat sealing bars could be used to apply heat and pressure for making both the zipper seals and the web cross seals.

In accordance with various embodiments of the invention, different methods for preventing seal-through of the zipper flanges, while the header seals and zipper/web seals are being formed on the FFS machine, can be employed. FIGS. 14-17 are drawings showing sectional views of the zippered portion of the work in the process of being sealed in the region between the profiles of a double zipper. Four different methods for preventing zipper flange seal-through are respectively illustrated. In each of FIGS. 14-17, the columns of Xs designated by numeral 90 and 92 represent the respective heat seals between the base webs 86 and 88 and the web 60 (formed before web 60 enters the FFS machine); the columns of Xs designated by numerals 200 and 202 represent the respective heat seals between the base webs 86 and 88 and the web 60 that will be formed when the top cross seals (not shown in FIGS. 14-17) are formed; and the column of Xs designated by numeral 194 represents the heat seal (or plurality of heat seals) between the common base web 84 and the web 60 that will also be formed when the top cross seals (and seals 200 and 202) are formed. The arrow G in each of FIGS. 14-17 indicates the gap between the free edges of the base webs 86 and 88.

Figure 14:
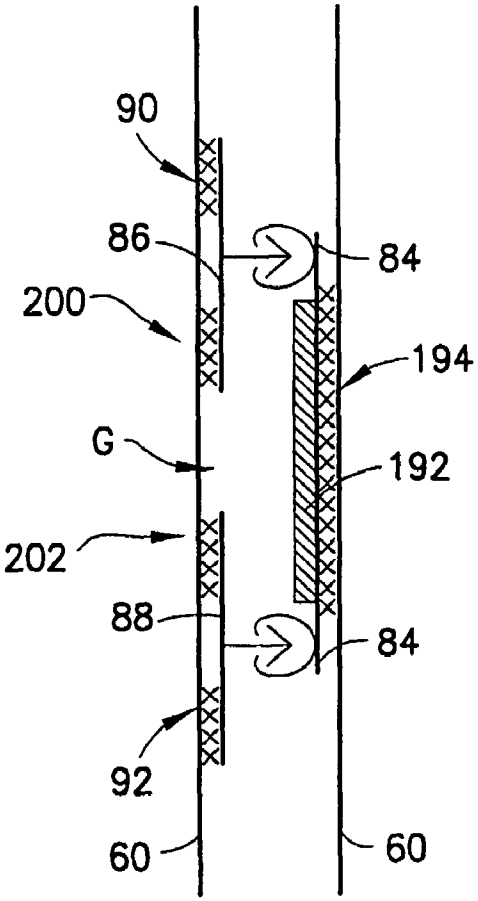

In accordance with the embodiment depicted in FIG. 14, a layer of peel seal material 192 is applied on the inner surface of the common base web 84, between the respective sets of zipper profiles. The peel seal 192 extends in a band from one end of the double zipper to the other. The peel seal reaches the FFS machine in an inactivated state and is activated by application of heat and pressure during a sealing operation. For the example depicted in FIG. 14, a single pair of mutually opposing reciprocating sealing bars (not shown), equal in width to the extent of seal 194, apply heat and pressure over a large portion of the region between the respective sets of zipper profiles when the sealing bars are in their extended positions. Preferably both sealing bars are heated. While the two layers of bag web and the zipper base webs are pressed between the heated sealing bars, the peel seal material 192 will be pressed against and adhered to opposing surfaces, including respective portions of the inner surfaces of the base webs 86 and 88 that overlie where the heat seals 200 and 202 will be respectively formed and the portion of web 60 coextensive with gap G. The adhesion of the peel seal material to the bag web in the region of gap G forms a wide cross seal (not shown in FIG. 14), which will later be bisected to form respective hermetic cross seals at the tops of respective bags (corresponding to top cross seals 134 and 136 seen in FIG. 8). At the same time that the peel seal material 192 is being activated, zipper/web heat seals 194, 200 and 202 are being formed. The presence of peel seal material between the common base web 84 and the opposing base webs 86, 88 in the region between the respective sets of zipper profiles prevents seal-through of the base webs, while also providing a tamper-evident feature above the zipper profile in each finished bag.

Alternatively, a pair of hermetic top cross seals and a pair of peel seals between the zipper base webs could be formed using four sets of heated sealing bars, in which case the single wide heat seal 194 would replaced by four narrower heat seals. The two outer sets of heated sealing bars (e.g., sealing bars 94, 96, 98, 100 seen in FIG. 3) would also form heat seals 200 and 202 respectively, while activating the peel seal material in the regions between the opposing portions of the zipper base webs. The-two inner sets of heated sealing bars (e.g., sealing bars 102, 104, 106, 108 seen in FIG. 3) would also form respective top cross seals (corresponding to top cross seals 134 and 136 seen in FIG. 8) by adhering the peel seal material to the portion of the web 60 where gap G is located, the cross seals being located in respective regions on opposite sides of the line where the bag web will ultimately be severed. In accordance with a further alternative, a single wide hermetic top cross seal (to be bisected later to form two top cross seals on different bags) and a pair of peel seals between the zipper base webs could be formed using three sets of heated sealing bars, in which case the single wide heat seal 194 would replaced by three narrower heat seals.

Figure 15:
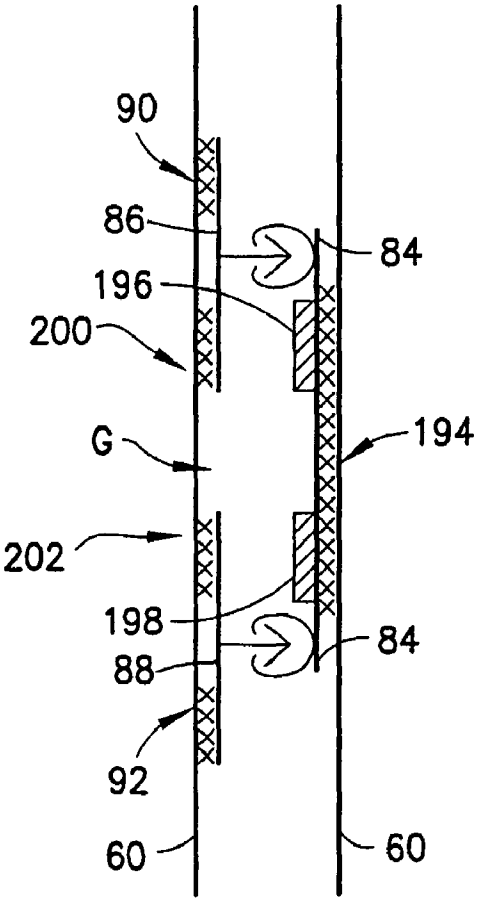
FIGS. 14-17 are drawings showing sectional views of the zippered portion of the work in the process of being sealed in the region between the profiles of a double zipper. Four different methods for preventing seal-through of the zipper flanges as the header seals and zipper/web seals are formed are illustrated in the respective drawings.

The embodiment shown in FIG. 15 differs from the embodiment of FIG. 14 in that instead of applying peel seal material, two bands 196 and 198 of non-sealant material (e.g., high-density polyethylene or a blend thereof) are applied on the inner surface of the common base web 84 in respective regions opposing the portions of base webs 86 and 88 that lie between the respective sets of zipper profiles. The bands of non-sealant material extend the full length of the double zipper. The term non-sealant material, as used herein, means a material that has a melting temperature that is higher than the melting temperature of the zipper base web material. Non-sealant material is not applied on the central portion of the inner surface of common base web 84 that is opposite to the gap G. During the application of heat and pressure, heat seals 194, 200 and 202 are formed between the bag web 60 and the zipper base webs 84, 86 and 88, respectively. Also the inner surface of the aforementioned central region of the common base web 84 will be heat sealed to the confronting portion of the base web 60 that is exposed by the gap G, thereby forming a cross seal (not shown in FIG. 15) to be bisected later to form respective top cross seals (corresponding to top cross seals 134 and 136 seen in FIG. 8). During this sealing operation, seal-through of base webs 86 and 88 to the common base web 84 is prevented by the presence of the bands of non-sealant material 196 and 198 respectively. Alternatively (or in addition), non-sealant material could be applied on the inner surfaces of opposing portions of base webs 86 and 88 that lie between the respective sets of zipper profiles. With respect to the embodiment depicted in FIG. 15, the same considerations (discussed in the preceding paragraph) apply as far as using three or four sets of sealing bars as opposed to a single set of wide sealing bars.

Figure 16:
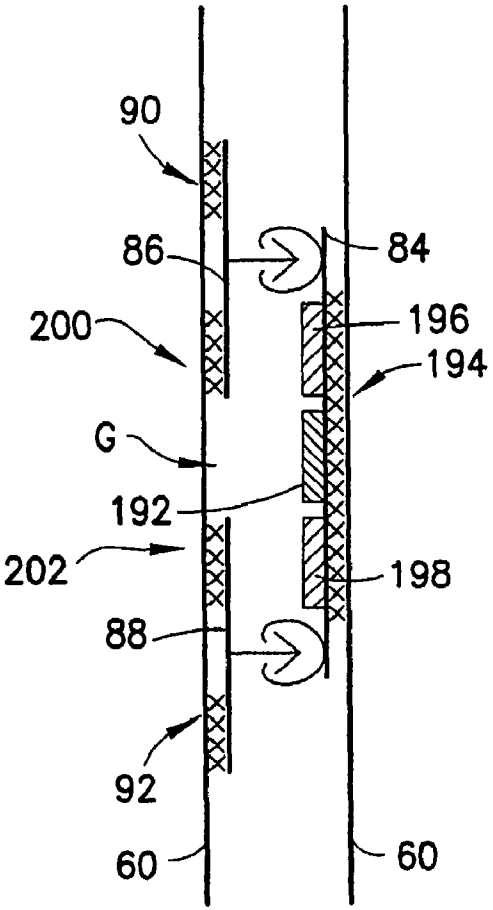

In accordance with a further embodiment shown in FIG. 16, two bands of non-sealant material 196 and 198 are applied on the inner surface of the common base web 84 (as previously disclosed with reference to FIG. 15) and a layer of peel seal material 192 is applied on the inner surface of the common base web 84 between the bands of non-sealant material 196 and 198 and opposite to the gap G. The peel seal 192 extends in a band from one end of the double zipper to the other. The peel seal reaches the FFS machine in an inactivated state and is activated by application of heat and pressure during the formation of heat seal 194 between the common base web 84 and the web 60. The adhesion of the peel seal material to the bag web in the region of gap G forms a cross seal (not shown in FIG. 16), which will later be bisected to form respective hermetic cross seals at the tops of respective bags (corresponding to top cross seals 134 and 136 seen in FIG. 8). At the same time that the peel seal material 192 is being activated, the presence of the bands of non-sealant material 196 and 198 between the common base web 84 and the opposing base webs 86, 88 prevents seal-through of the base webs.

Figure 17:
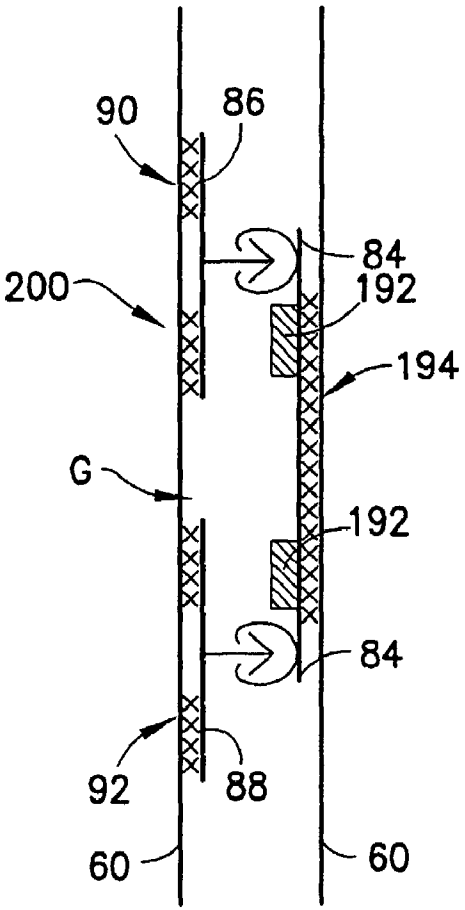

In accordance with yet another embodiment of the invention shown in FIG. 17, instead of applying a layer of peel seal material on the inner surface of the base web 84 equal in width to the heat seal 194 to be formed between the common base web 84 and the web 60, separate peel seals 192 can be formed between the common base web 84 and opposing portions of the base webs 86 and 88 in a secondary operation before the double zipper is attached to the web 60. Later when the heat seal 194 is formed, the central portion of the common base web 84 will be heat sealed to the portion of the web 60 exposed by the gap G (which sealed region will be bisected to form two top cross seals), while the presence of the peels seals 192 between the common base web 84 and the opposing base webs 86, 88 prevent seal-through of the base webs.

Referring now to FIG. 7, during each even-numbered dwell time, the lowermost bag is upside-down, with the bottom of the bag above the top of the bag, the top being closed by the zipper and the bottom being open. During each even-numbered dwell time, the gusset plows are extended. When the gusset plows are extended, they push in the sides of the film tube 60', thereby forming opposing side gussets 142 and 144, each gusset comprising a pair of overlapping gusset panels. While the gusset plows are thus extended, the upside-down bag is filled with product. Then the web cross sealing bars are again extended to form a pair of bottom cross seals 138 and 140 across the gusseted portion of the film tube by conduction heat sealing. Concurrently with formation of the bottom cross seals, the film tube is cut along transverse cut line 128, thereby severing the filled upside-down package from the remainder of the work in process.

Figure 9:
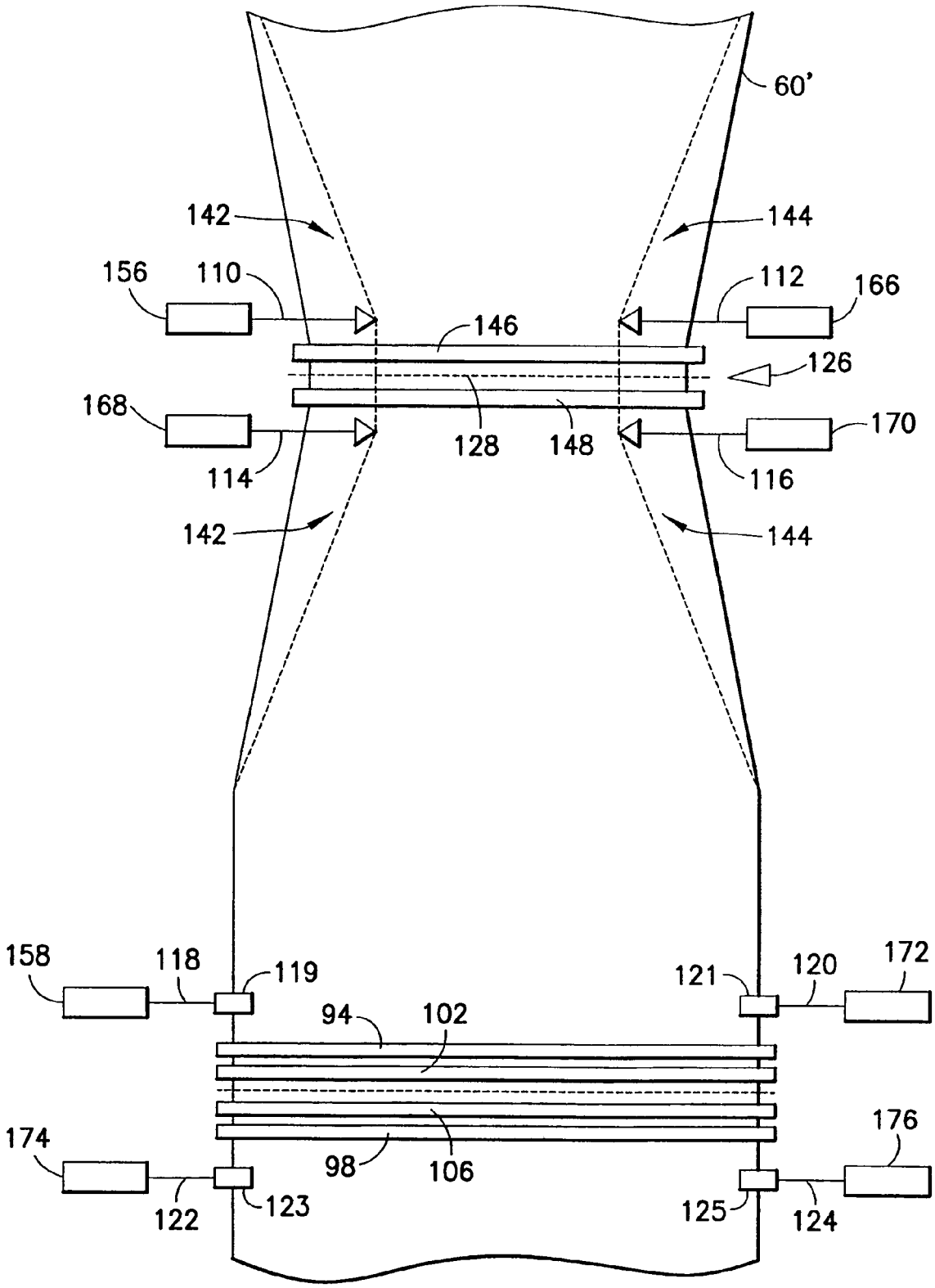
FIG. 9 is a drawing showing various components of a machine in accordance with a second embodiment of the invention.

In accordance with the first method of manufacture described with reference to FIGS. 6 and 7, one finished filled reclosable package is made per cycle. In accordance with a second method of manufacture, two finished filled bags, connected at the tops in so-called "saddlebag" fashion, are made for each cycle. In this case, the zipper sealing, top cross sealing, bottom cross sealing, gusseting, spreading and cutting operations are all performed during the same dwell time. Portions of a VFFS adapted to operate in accordance with this second method of manufacture are shown in FIG. 9. The machine shown in FIG. 9 differs from that shown in FIG. 5 in several respects.

First, the double zipper/film tube assembly is advanced with an indexing distance two times greater than that of the embodiment depicted in FIG. 5, i.e., by a distance equal to the length of film tube needed to make two reclosable bags joined at their tops in saddlebag fashion.

Second, top and bottom cross seals are made during each dwell time instead during alternating dwell times. Therefore four pairs of cross sealing bars are provided, only four of which are shown in FIG. 9, designated by the numerals 102, 106, 146, 148. The respective opposing cross sealing bars are not visible in FIG. 9. The centerline between the upper two pairs of cross sealing bars is separated from the centerline between the lower two pairs of cross sealing bars by a distance equal to one-half of the indexing distance. In the example depicted in FIG. 9, the upper set of cross sealing bars (146, 148 et al.) form bottom cross seals, while the lower set of cross sealing bars (102, 106 et al.) form top cross seals.

Third, the embodiment shown in FIG. 9 differs from that shown in FIG. 5 in that the spreaders 118, 120, 122, 124 are placed above and below the upper set of cross sealing bars, while the gusset plows 110, 112, 114, 116 are placed above and below the lower set of cross sealing bars, instead of spreaders and gusset plows being placed above and below the same set of cross sealing bars as shown in FIG. 5. Moreover, the spreaders and gusset plows in the embodiment shown in FIG. 9 operate during each dwell time, as opposed to alternatingly operating the spreaders during odd-numbered dwell times and the gusset plows during even-numbered dwell times, which was the case for the embodiment shown in FIG. 5.

In the embodiment shown in FIG. 9, when the film tube is cut along the transverse cut line by knife 126, two bags connected at their tops in saddlebag fashion are severed from the remainder of the work in process.

The film tube can be advanced (downwardly) by any conventional means, such as vacuum-assisted drive belts that contact the film wrapped around the fill tube. To implement indexing of the film tube using vacuum-assisted drive belts, for each drive belt a gearbelt pulley is mounted to the end of the shaft of one of the belt rollers. The pulley is driven by a gearbelt, causing the roller to rotate. A programmable controller controls a servomotor, which in turn drives the pulley, causing the roller to rotate to the extent needed to advance the film tube by the indexing distance.

FIG. 10 is a block diagram that seeks to demonstrate how all of the above-described operations are coordinated by a PLC 150. The PLC is programmed to send activation signals to all of the various actuators in accordance with a routine selected by the system operator at a control console (not shown). FIG. 10 shows only a subset of the activation signals that will ordinarily be outputted by the PLC 150. In this implementation, the PLC 150 outputs signals that control both zipper sealing bar actuators (only representative sealing bar actuator 152, which causes zipper sealing bars 94 and 98 to reciprocate is shown in FIG. 10). Secondly, the PLC 150 also outputs signals that control both web cross sealing bar actuators (only representative web cross sealing bar actuator 154, which causes web cross sealing bars 102 and 106 to reciprocate, is shown in FIG. 10). Thirdly, the PLC 150 outputs signals that control all gusset plow actuators (only gusset plow actuator 156, which causes gusset plow 110 to reciprocate, is shown in FIG. 10). Fourthly, the PLC 150 outputs signals that control all spreader actuators (only spreader actuator 158, which causes spreader 118 to reciprocate, is shown in FIG. 10). The PLC 150 also controls the gripping movements by the spreader, which gripping operation is performed after the spreader has been extended and before it is retracted. In the case where each spreader comprises a set of parallel grippers, the PLC controls the supply of air to the double-acting pneumatic cylinder that actuates the grippers. Lastly, the PLC 150 controls the servo motors that cause the web drive belts to circulate. A representative web drive belt 162 and associated servomotor 164 are shown in FIG. 10.

The PLC can be suitably programmed to actuate the sealing bars, gusset plows and spreaders in accordance with any of the methods of manufacture disclosed herein.

With regard to each set of mutually opposing transverse sealing bars, at least one of the sealing bars of each set must be heated. The temperature of each heated sealing bar is controlled by a programmable heat controller (not shown). The dwell time of each heated sealing bar in the extended position is controlled by the PLC.

Hydraulic cylinders can be employed in place of air, i.e., pneumatic, cylinders. A person skilled in the art of machinery design will readily appreciate that displacing means other than a cylinder can be used to displace the reciprocatable sealing bars. For the sake of illustration, such mechanical displacement devices include rack and pinion arrangements, rotation of the pinion being driven by an electric motor.

Figure 13:
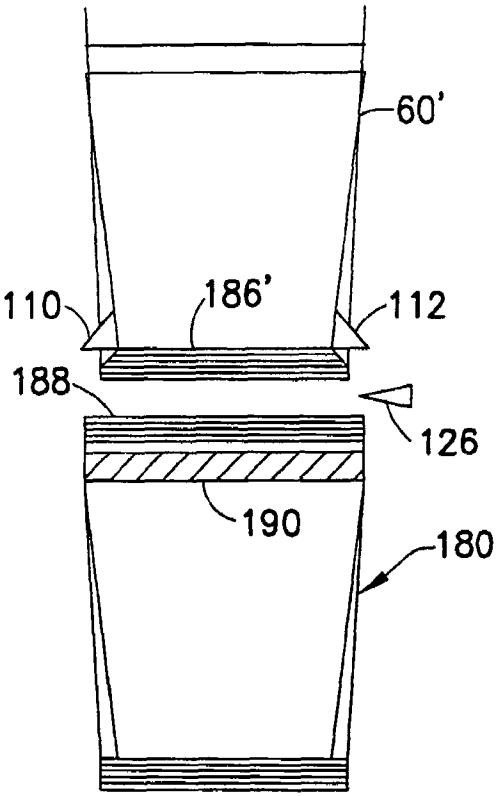
FIGS. 11-13 are drawings showing three stages in the manufacture of block bottom pillow top reclosable bags in accordance with a second method of manufacture that does not require reversal of the printed matter on alternating bags.
Figure 12:
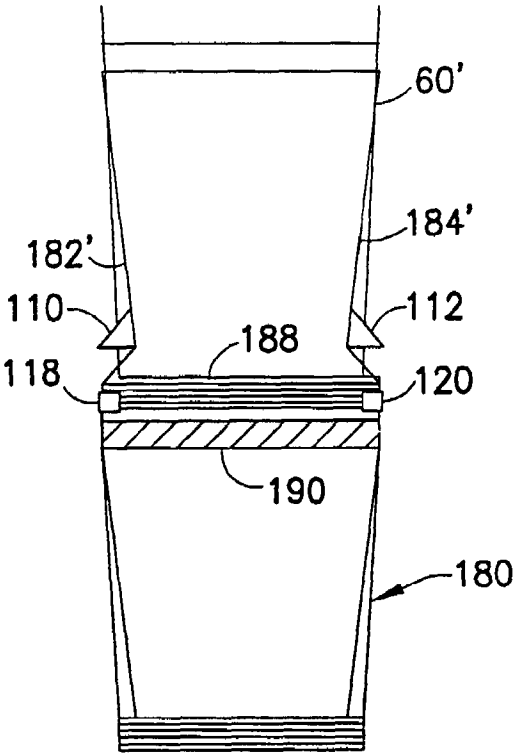
Figure 11:
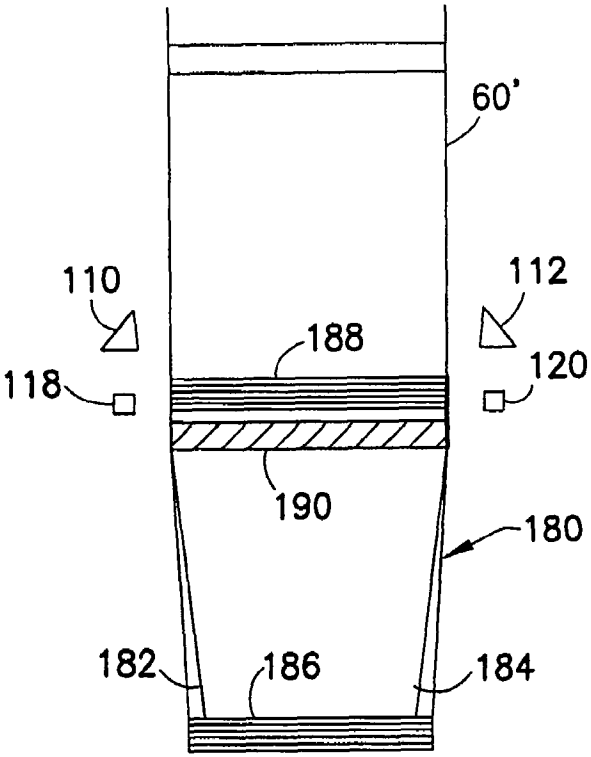

FIGS. 11-13 are drawings showing three stages in the manufacture of block bottom pillow top reclosable bags in accordance with a second method of manufacture that does not require reversal of the printed matter on alternating bags. In the stage depicted in FIG. 11, a block bottom pillow top reclosable bag 180 is still connected at its top to a film tube 60' depending from the VFFS machine. Bag 180 has a pair of side gussets 182, 184, a bottom seal 186, a top seal 188, and a zipper seal 190 (the seal on the other side of the zipper is not shown). At the stage of manufacture depicted in FIG. 11, a pair of gusset plows 110 and 112 disposed on opposite sides of the film tube 60' are both retracted, and a pair of spreaders 118 and 120 disposed on opposite sides of the film tube 60' are both retracted.

In the next stage of manufacture, first the spreaders 118, 120 are extended. In their extended positions, the spreaders 118 and 120 grip the bag 180 in the area of its top seal 188. The spreaders are then retracted and pull the marginal portions apart, thereby spreading that top seal and the contiguous portion of the film tube 60' immediately above the top seal. In this state, the gusset plows 110, 112 are extended to push in the sides of the film tube 60', thereby forming side gussets 182' and 184'. FIG. 12 shows the stage of manufacture whereat the spreaders, while gripping the film tube, are retracted and the gusset plows are extended. In the next operation, a bottom seal 186' will be formed above the top seal 188 of the lowermost bag 180. The result of this operation is shown in FIG. 13. Once the bottom seal for the trailing bag has been formed, the leading bag 180 can be severed from the film tube 60' by a knife or other cutting instrument 126.

Each of the embodiments disclosed above incorporates a reclosable feature. However, the methods disclosed above can also be employed to make block bottom pillow top bags that are not reclosable. In that event, no steps need to be taken to join a reclosable feature to the web of bag making material. For example, in the respective apparatus shown in FIGS. 5 and 9, the transverse sealing bars 94 and 98 would not be needed.

While the invention has been described with reference to certain embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. Furthermore, in the absence of explicit language in any method claim setting forth the order in which certain steps should be performed, the method claims should not be construed to require that steps be performed in the order in which they are recited.

The invention claimed is:

1. A method of making a block bottom pillow top bag, comprising the following steps:

(a) forming a web of bag making material into a tube having a length that defines a lengthwise direction and sealing a longitudinal seam of said tube, said longitudinal seam extending in said lengthwise direction;

(b) joining respective confronting portions of said tube along a transverse direction transverse to said lengthwise direction to form a first transverse zone of web joinder having a length approximating one half of a perimeter of said tube;

(c) forming mutually opposing first and second gussets in said tube, said first and second gussets being separated from each other in said transverse direction by a minimum distance at a predetermined distance from said first transverse zone of web joinder, said distance of gusset separation increasing from said minimum distance in the directions toward and away from said first transverse zone of web joinder;

(d) placing a first amount of product in a first portion of an interior volume of said tube disposed above said first transverse zone of web joinder, said first amount of product not reaching an elevation where said first and second gussets are separated by said minimum distance;

(e) joining confronting portions of said tube along said transverse direction to form a second transverse zone of web joinder that fixes portions of said first and second gussets that are separated by said minimum distance, wherein said second transverse zone of web joinder hermetically seals said first portion of said interior volume of said tube;

(f) cutting said web along a first transverse cut line located below said first transverse zone of web joinder; and (g) cutting said web along a second transverse cut line located above said second transverse zone of web joinder, said second transverse cut line intersecting said portions of said first and second gussets that are separated by said minimum distance.

2. The method as recited in claim 1, further comprising the following steps performed prior to step (a):

(h) placing a first reclosable feature transverse and adjacent to a first portion of said web that will not be gusseted during step (c); and (i) joining one side of said first reclosable feature to said first portion of said web, wherein subsequent to step (b), said first reclosable feature extends parallel to and above said first transverse zone of web joinder.

3. The method as recited in claim 2, further comprising the step, performed concurrently with step (b), of joining another side of said first reclosable feature to a second portion of said web that will not be gusseted during step (c).

4. The method as recited in claim 1, further comprising the following step, performed prior to step (g):

(h) joining confronting portions of said tube along said transverse direction to form a third transverse zone of web joinder that extends parallel to said second transverse zone of web joinder, wherein said second and third transverse zones of web joinder are equidistant from said second transverse cut line during step (g), and said third transverse zone of web joinder intersects said portions of said first and second gussets that are separated by said minimum distance.

5. The method as recited in claim 4, further comprising the following steps performed subsequent to step (h):

(i) placing a second amount of product in a second portion of said interior volume of said tube disposed above said third transverse zone of web joinder;

(j) joining respective confronting portions of said tube along a transverse line to form a fourth transverse zone of web joinder having a length approximating said first transverse zone of web joinder; wherein said fourth transverse zone of web joinder hermetically seals said second portion of said interior volume of said tube; and (k) cutting said web along a third transverse cut line located above said fourth transverse zone of web joinder.

6. The method as recited in claim 5, further comprising the following steps performed prior to step (a):

(h) placing a second reclosable feature transverse and adjacent to a third portion of said web that will not be gusseted during step (c); and (i) joining one side of said second reclosable feature to said third portion of said web, wherein subsequent to step (j), said second reclosable feature extends parallel to and below said fourth transverse zone of web joinder.

7. The method as recited in claim 6, further comprising the step, performed concurrently with step (j), of joining another side of said second reclosable feature to a fourth portion of said web that will not be gusseted during step (c).

8. The method as recited in claim 1, further comprising the steps of:

(h) advancing said web of bag making material by an indexing distance, said web having first and second marginal portions; and (i) attaching first and second reclosable features to said web so that said first and second reclosable features each extend in a transverse direction with a spacing between said first and second reclosable features that is substantially less than said indexing distance, wherein said step of sealing said longitudinal seam of said tube in step (a) comprises joining respective portions of said first and second marginal portions of said web, and steps (h) and (i) are performed before step (a).

9. The method as recited in claim 8, wherein said first reclosable feature comprises a first zipper that in turn comprises first and second profiled closure members that are interlocked with each other, and said second reclosable feature comprises a second zipper comprising third and fourth profiled closure members that are interlocked with each other, said first and third profiled closure members being connected to respective portions of a common base, said common base being severed by said first transverse cut line.

10. The method as recited in claim 9, wherein said second profiled closure member is connected to a first zipper base, said fourth profiled closure member is connected to a second zipper base, and step (i) comprises the following steps:

joining said first zipper base to a first portion of said web to form a first transverse zone (90) of zipper-to-web joinder;

joining said second zipper base to a second portion of said web to form a second transverse zone (92) of zipper-to-web joinder; and joining said common base to third and fourth portions of said web to form third and fourth transverse zones (130, 132) of zipper-to-web joinder.

11. The method as recited in claim 10, further comprising the steps of placing peel seal material between one portion of said web and an inner surface of a central portion of said common base and then applying heat and pressure sufficient to activate said peel seal material while at the same time joining another portion of said web to an outer surface of said central portion of said common base web.

12. The method as recited in claim 10, further comprising the step of joining respective portions of said web to opposite sides of said common base to form fifth and sixth transverse zones (134, 136) of zipper-to-web joinder that may be contiguous or not, said fifth transverse zone of zipper-to-web joinder being located between said third transverse zone of zipper-to-web joinder and said first transverse cut line, and said sixth transverse zone of zipper-to-web joinder being located between said fourth transverse zone of zipper-to-web joinder and said first transverse cut line.

13. The method as recited in claim 10, further comprising the step of spreading said web in a vicinity of said common base and maintaining said spread web while said common base is joined to said web.

14. The method as recited in claim 8, further comprising the step of printing first matter on a first portion of said web and second matter on a second portion of said web, thereby forming first and second printed portions of said web, said first printed portion being disposed on one side of said first and second reclosable features, and said second printed portion being disposed on another side of said first and second reclosable features, said first and second matter comprising substantially the same graphic design except that said graphic design of said second matter is rotated about 180 degrees relative to said graphic design of said first matter.

15. The method as recited in claim 8, wherein a spacing between said first and second transverse zones of web joinder is substantially less than said indexing distance.

16. The method as recited in claim 8, wherein said first transverse cut line is located between said first and second reclosable features, and said second transverse cut line is located between said first and second transverse zones of web joinder.

17. The method as recited in claim 8, wherein a spacing between said first and second transverse zones of web joinder is substantially less than said indexing distance.

18. The method as recited in claim 8, wherein a spacing between said first and second transverse zones of web joinder is substantially less than said indexing distance.

19. The method as recited in claim 8, wherein said first transverse zone of web joinder has a length less than a length of said first reclosable feature.

* * * * *